US005572744A

United States Patent [19]

Reid, Jr. et al.

[11] Patent Number: 5,572,744

[45] Date of Patent: Nov. 12, 1996

[54] MITTEN SUITABLE FOR HEAT TRANSFER

[75] Inventors: Lawrence G. Reid, Jr., Germantown; Eleanor B. Reid, Winston-Salem, both of N.C.

[73] Assignee: Carolon Company, Rural Hall, N.C.

[21] Appl. No.: 508,863

[22] Filed: Jul. 28, 1995

[51] Int. Cl.[6] ..... A41D 19/00

[52] U.S. Cl. ..... 2/158; 2/160; 2/164

[58] Field of Search ..... 2/158, 159, 164, 2/160, 167, 161.6, 161.7; 607/111, 112, 113

[56] References Cited

U.S. PATENT DOCUMENTS

| | | | |
|---|---|---|---|
| 2,493,977 | 1/1950 | Kochman | 2/160 |
| 2,792,827 | 5/1957 | Gravin et al. | 2/159 |
| 2,842,771 | 7/1958 | Foti | 2/159 |
| 3,114,915 | 12/1963 | Gross | 2/164 |
| 4,535,482 | 8/1985 | Spector et al. | 2/160 |
| 4,759,084 | 7/1988 | Madnick et al. | 2/158 |
| 5,187,814 | 2/1993 | Gold | 2/160 |

FOREIGN PATENT DOCUMENTS

| | | | |
|---|---|---|---|
| 2118023 | 10/1983 | United Kingdom | 2/158 |

*Primary Examiner*—Amy B. Vanatta
*Attorney, Agent, or Firm*—Petree Stockton L.L.P.

[57] ABSTRACT

A mitten is provided with pouches for receiving packages of heat transfer material. The packages of heat transfer material are inserted into the pouches and the mitten is placed in a microwave to heat the material or in a freezer to cool the material. After sufficient heating or cooling, the mitten may be removed and placed on the user's hand to provide hours of warmth or cold. The mitten may be provided with velcro™-type fasteners so as to secure the mitten around the arm of the user.

14 Claims, 1 Drawing Sheet

FIG. 1
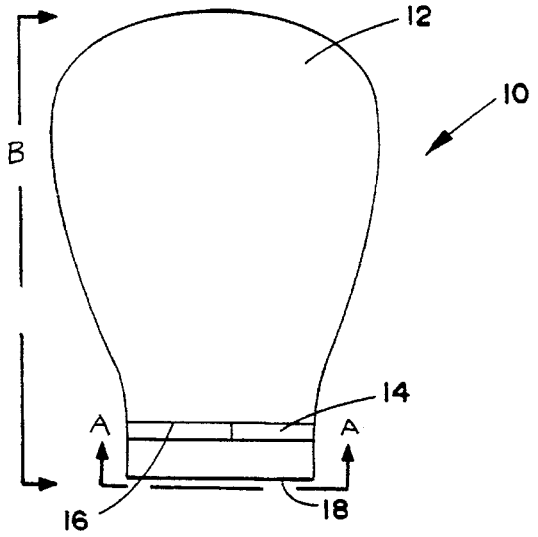
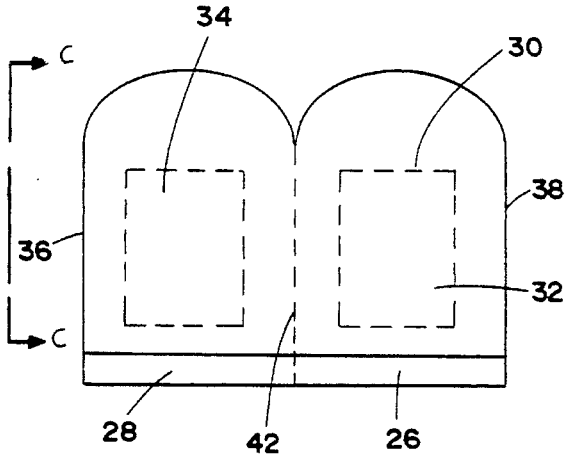
FIG. 3
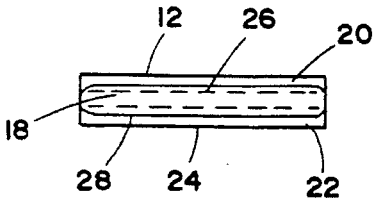
FIG. 2
FIG. 4
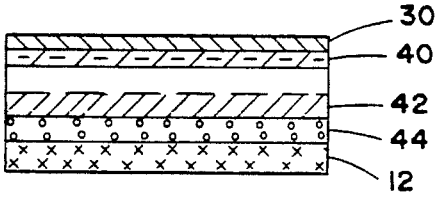

MITTEN SUITABLE FOR HEAT TRANSFER

FIELD OF THE INVENTION

The present invention relates to a mitten suitable for providing warmth and cold for an extended time period to the extremities of the wearer. The mitten is provided with pouches for receiving packages of heat absorbing and retaining material and heat extracting material. The heat absorbing and retaining material may be heated by use of a microwave or other suitable heating methods. The heat extracting material may be ice or other suitable cooling material.

BACKGROUND AND SUMMARY OF THE INVENTION

Various types of products are known for providing heat or cold to a body part of the user. Examples of such known products are:

U.S. Pat. No. 5,035,241 discloses a reusable and microwavable hot insulated compress having a bottom laminate, a first pocket containing a gel, a middle laminate being positioned above the first pocket and including a top layer of insulative material, a second pocket being provided with a dead air space as additional insulation above the insulative material, and a top laminate being positioned above the second pocket. The bottom, middle and top laminates each have outer peripheral edges that are bonded together by a radio frequency (RF) heat-sealing step. A method is also disclosed for manufacturing the compress.

U.S. Pat. No. 5,050,596 also discloses a reusable and microwavable hot or cold therapy mitt for a user's hand which has a bottom laminate, a first pocket containing a gel, a middle laminate being positioned above the first pocket, a second pocket being provided with an open air space for receiving the user's hand which above the middle laminate, a layer of open-celled material being positioned above the second pocket, a layer of insulative wadding being placed above the layer of open-celled material, a third pocket being provided with dead air space for additional insulating above the layer of insulative wadding, and a top laminate being positioned above the third pocket. A strap fastens the therapy mitt securely on the user's hand. A method is also disclosed for manufacturing the therapy mitt. The bottom, middle and top laminates each have outer peripheral edges that are boded together by a radio frequency (RF heat-sealing step with outer peripheral edges of the layer of open-celled material and of the layer of insulative wadding.

U.S. Pat. Nos. 5,150,FOF and 4,488,552 are directed, respectively to a thermal pack having a high heat-retention character which may be quickly heated or chilled consisting of an absorbent package having a gel-forming synthetic organic resin in particulate form deposited on an adhesive coated substrate disposed between a pair of fibrous non-woven porous filter layers and covered on the outside by a pair of paper-like plies of non-woven porous absorbent material. The outside covers are seamed together around their periphery to form a closed envelope.

The thermal pack may be positioned in a pouch which is adapted to be held in place over the afflicted area of the body by releasable fastening means. The pack and pouch are formed of porous material which is capable of being heated in microwave oven or cooled in a freezer.

In making the absorbent pack, a predetermined quantity of particulate gel-forming resinous material is deposited on the adhesive surface of the substrate, which is water-soluble so that in use, when the assembly is immersed in water, the gel-forming synthetic organic resinous material is free to expand as a gel and fill the envelope provided by the peripheral seaming. A piece of polyurethane foam wrapped by an absorbent material such as terry cloth or cotton batting, is saturated with water, placed in an inner nylon bag, and disposed in an envelope made of foam-lined flocked fabric, to form the pack. The pack is placed in a microwave oven to heat the water, and when removed is placed on a body part to be treated. The pack may be reheated and re-used, without opening, repeatedly. The outer covering is longer than the inner core, and can be folded-over to provide several thicknesses of insulation on one face of the pack, while the other face has a single thickness.

U.S. Pat. 5,187,814 discloses a heated garment such as a mitten, glove or sock, for heating at least a portion of the body part with a heater pack. The mitten, glove or sock covers at least a portion of a body part and has at least one opening for insertion the body part. A chamber assembly is coupled to the inside of the garment for creating an elongated chamber in the garment accessible through the garment opening. A pocket assembly is coupled to the garment for receiving the heater pack and is adapted to be removably inserted to the elongated cheer. Inserting the pocket assembly with the heater pack into the elongated chamber of the garment transmits heat to the wearer's covered body part in an efficient fashion without unnecessarily restricting mobility or increasing bulkiness.

U.S. Pat. No. 4,543,671 discloses a heated mitten having a pouch disposed in its interior which is supported by the mitten so as to be moveable relative to the hand of a user. The mitten is provided with an opening in its exterior which communicates with the interior of the pouch whereby a heating element may be placed in the pouch.

U.S. Pat. No. 4,587,672 is directed to a glove provided with a chemical heating element. In one embodiment, a fingerless glove hand covering having a substantially rectangular shaped chemical heating element receiving cheer confronting the palm side of the base of the fingers is disclosed. The fingers are warmed by so clenching the hand as to bring the fingers into direct heat receiving contact with the heating chamber, and heat transmitted thereby into the palm heats the blood and warms the fingers by circulation. In another embodiment, a mitt hand covering having substantially heel-shaped chemical heating element receiving chamber confronting either the back surface or the front surface of the fingers including the fingertips is disclosed. The fingers are warmed directly by heat transmitted to the entire surface of the fingers and fingertips by the heel-shaped chemical heating element chamber. In a further embodiment, a glove hand covering having an articulated finger and them shaped chemical heating element receiving cheer confronting either the back surface or the front surface of the individual fingers and thumb is disclosed. The fingers and thumb are warmed directly by heat individually transmitted thereto by the articulated finger and them shaped chamber. In a further embodiment, a mitt hand covering having a hand-shaped chemical heating element receiving chamber confronting either the front or the back of the hand is disclosed. The fingers and thumb are collectively warmed directly by the hand-shaped chamber. In each of the disclosed embodiments, a selectively shaped chemical heating element is removably retained in the corresponding one of the selectively shaped chambers, and the several embodiments can be employed as either independent hand coverings or as liners.

U.S. Pat. No. 4,671,267 discloses treating of sprains, muscle aches, orthopedics and skin injuries such as burns and other wounds and made use of a pliable, self-sustaining, moisture absorbing element including a humectant such as glycerin entrapped within a synthetic resin polymer matrix (e.g., a matrix containing acrylic acid or acrylamide monomer moieties. In one preferred embodiment, a body of the gel is encased within heat and moisture-permeable stretch fabric, and securing ties or the like are provided to permit the composite to be conformed to a body part and held in place. In use, such therapy wraps are either heated (as in a microwave oven or refrigerated, so as to provide appropriate thermal treatment; it has been found that the preferred gel of the invention retains its pliability and other physical properties over a very broad temperature range, such as −20 degrees to 305 degrees F., and therefore the wraps of the invention can be used in many treatment contexts. It has also been discovered that the gel material can be applied directly to injured skin to in effect create a temporary skin with ideal air permeability. Furthermore, the moisture absorbing and desorbing properties of the gel create a moisture equilibrium between the gel, damaged skin and the atmosphere, thus promoting rapid healing.

U.S. Pat. Nos. 4,727,602 and 4,472,579 disclose, respectively, an insulated handwear construction which has an outer shell, an inner lining and an insulation material having thermal convection passages therein positioned between the shell and inner lining. The insulation material connects to a source of heat located on either the palm side or back side of the handwear construction and extends over finger and thumb portions to transfer heat from the heat source to the finger and thumb tips of a wearer.

A glove covering for use in winter sports protects a hand against cold weather and comprises an outer glove shell which includes a finger section, thumb section, palm/wrist section and pocket for a flexible heater pack. Pocket members are attached at the finger and thumb sections to allow insertion of a user's fingers and thumbs within the pockets. The palm/wrist section of the shell is open and provides a pocket structure for holding the heater pack in an insulated location to retain generated warmth at the contained glove or hand. A single glove structure is also shown with a heater back secured within a pocket to provide a heat source to the wearer.

U.S. Pat. No. 4,756,311 is directed a microwavable heat and/or cold gel package in which the package is formed of a laminate and encloses the aqueous gel therein.

U.S. Pat. No. 4,759,084 discloses a cold weather hand covering having a chemical heating element receiving chamber. In one embodiment, a mitt hand covering has the receiving chamber confronting either the front or the back of the hand.

The present invention is directed to overcoming problems associated with each of the foregoing patents. In particular, the present invention is directed to providing relief to people afflicted with arthritis, poor circulation and similar medical problems often associated with senior citizens by providing a soothing warmth thereto. In other instances, users may require the afflicted part to be subject to cooler temperatures, e.g., in the treatment of sprains, surgery, etc. The mitten of the present invention provides ease of use by having pocket parts for receiving pre-packaged heat absorbing and retaining material or heat extracting material. Such material may be of any lightweight, well-known material such as a gel or a solid which provides a large surface area for enhancing the heat absorbing and retaining property or heat extracting property. The pre-packaged material can be inserted into pocket parts provided in the mitten so as to permit the entire mitten to be placed in a microwave for heating or to place the entire mitten in a freezer for cooling. Of course, other suitable heating and cooling processes may be utilized. These processes could permit the heating and cooling of the pre-packaged material in the presence or absence of the mitten. For example, the pre-packaged material may be heated or cooled separately from the mitten and subsequently inserted into the pocket parts of the mitten. After heating or cooling, the mitten is used by inserting the hand of the user into the mitten. To facilitate senior citizens use of the mitten a velcro-type fastener is used to secure the mitten on the arm of the user. The mitten is of such size as to enable the user to cover both the hand and wrist portions of the body.

BRIEF DESCRIPTION OF THE DRAWINGS

FIG. 1 is a top plan view of the mitten showing a fastening device at the arm portion;

FIG. 2 is an end view taken in the direction of the arrows A—A of FIG. 1;

FIG. 3 is a top plan view of the hand receiving portion of the mitten separated along the side seam in the direction of the arrows B—B of FIG. 1.; and FIG. 4 is a side view of the mitten taken along the Arrows C—C of FIG. 3 to show the component layers.

DETAILED DESCRIPTION OF A PREFERRED EMBODIMENT

FIG. 1 shows the mitten of the present invention generally at reference number 10. An outer covering 12 completely covers the mitten. The outer covering 12 may be of any material which is aesthetically pleasing in appearance; however, the material is preferably cloth and is quilted to inner sections (not shown in FIG. 1) of the mitten 10. Velcro(™)-type fastener sections 14 and 16 are provided along an arm section of the mitten so as to secure the mitten in place on the user's hand and wrist. An opening 18 is provided at the wrist end of the mitten for receiving the user's hand.

With reference to FIG. 2, the opening 18 is shown in end view of the mitten. Additional openings 20 and 22 are provided along the top 13 and bottom 24 of the mitten. The additional openings provide access to pockets parts at the top and bottom of the mitten for receiving packages of heat transfer material therein. An example of a heat transfer material is a gel-type material which is encased in plastic to prevent leakage. After insertion of the heat transfer material packages, end portions 26 and 28 of the cloth covering 12 are tucked into the openings to retain and secure the pre-packaged heat transfer material in the pocket parts.

FIG. 3 shows the mitten partially disassembled along a seam taken in the direction of the arrows B —B of FIG. 1. A flannel-type cloth 30 lines the interior for contact with the hand and/or wrist of the user. Packages of heat transfer material 32 and 34 are positioned on either side of the mitten in pocket parts covered by end flaps 26 and 28.

FIG. 4 is a side view of the multi-layer construction of the mitten taken along the arrows C —C of FIG. 3. It is to be understood that each layer is co-extensive from the side 36 to the side 38 of the mitten. Fixedly attached to the back of the cloth layer 30 is a liquid impervious material 40. Various types of plastics are preferred for this purpose; however, any material of a soft, pliable liquid-proof nature may be used. The liquid impervious layer prevents contact of the heat transfer material in the event the pre-packaged heat transfer material leaks. Such material may sometimes be of a caustic nature to skin or if sufficient temperature differential exists between the skin and heat transfer material, the skin could be burned. The layer 40 defines a first side of a pocket part on either side of seam 41. A second side of the pocket part is defined by a backing material layer 42. Any suitable material such as rayon may be used. In order to satisfy the suitability requirement, the material must have a low coefficient of friction in order to permit the ease of insertion of the heat transfer material packages and must be strong enough to hold the threads which provide the quilting effect of the outer covering 12. Of course, the quilting effect is not merely decorative but also provides for additional heat transfer capabilities of the mitten by assisting in the trapping of air which is a well known insulator. Between the backing layer 42 and the outer covering 12 is a further layer of pliable, soft material 44 which also has an insulating property. In addition to insulation, the layer 44 also protects the heat transfer packages 32 and 34. The outer covering 12, the backing layer 42 and the further layer are not liquid impervious. In the event the pre-packaged heat transfer material is caustic to skin, any seepage of the material from its pre-packaged state, would transfer through the layers of the pocket part on the second side so as to alert the user of the leakage and to warn the user to discontinue use of the heat transfer mitten.

In use, the mitten and heat transfer material are purchased as a unitary item. In one example of use, the mitten is placed in a microwave and heated for a sufficient time (usually 1–2 minutes to heat the heat transfer material packages contained within the pocket parts. After sufficient heating, the mitten is removed and the user can insert his or her hand therein. The fastener may then be utilized to tighten the end of the mitten around the arm of the user so as to secure the mitten thereon. Another example would be to place the pre-packaged heat transfer material with or without the mitten into a freezer so as to provide a cooling effect for the user.

The foregoing preferred embodiment is considered illustrative only. Other modifications will occur to those persons skilled in this particular area of technology. Accordingly, the disclosed invention is not limited to the exact structure and method of use described herein, but rather is defined by the claims as appended hereto.

What is claimed is:

1. A mitten adapted to cover the entire hand and wrist of a user, comprising:

a main opening for providing access to the interior of the mitten and receiving the hand and wrist of the user;

a first opening defining a first pocket part for receiving a heat transfer material;

a second opening defining a second pocket part for receiving a second heat transfer material;

an outer covering defining the exterior of the mitten;

insulation material attached to the interior of the outer covering;

a soft cloth lining the interior of the mitten; and a liquid impervious material attached to an exterior side of the cloth lining and defining a first side of said first and second pocket parts.

2. A mitten according to claim 1 further comprising a backing material attached to the insulation material opposite to said outer covering.

3. A mitten according to claim 2 wherein the outer covering, the insulation material and the backing material are fixedly attached to each other to form a first unitary portion of the mitten.

4. A mitten according to claim 3, wherein the cloth lining and the liquid impervious material are fixedly attached to each other to form a second unitary portion of the mitten.

5. A mitten according to claim 1, further comprising a heat transfer material provided in at least one of said first and second pocket parts.

6. A mitten according to claim 5, wherein said heat transfer material is a gel.

7. A mitten according to claim 6, wherein said gel is enclosed in a fluid impervious package.

8. A mitten according to claim 1, further comprising a fastener attached to said outer covering for securing the mitten to the arm of the user.

9. A mitten according to claim 1, wherein said first and second pocket parts are on opposite sides of said opening.

10. A mitten according to claim 2, wherein the backing material and the insulation material define a second side of said first and second pocket parts.

11. A mitten according to claim 10, wherein said second side of said mitten is liquid permeable to permit seepage of the heat transfer material through said outer covering so as to warn the user upon rupture of said heat transfer material and leakage resulting from the rupture.

12. A mitten adapted to cover the entire hand and wrist of a user, comprising:

an opening for providing access to the interior of the mitten and receiving the hand and wrist of the user;

a first pocket part for receiving a heat transfer material;

a second pocket part for receiving a second heat transfer material;

an outer covering defining the exterior of the mitten;

insulation material attached to the interior of the outer covering;

a soft cloth lining the interior of the mitten;

a liquid impervious material attached to an exterior side of the cloth lining and defining a first side of said first and second pocket parts; and a heat transfer material provided in at least one of said first and second pocket parts.

13. A mitten according to claim 12, wherein said heat transfer material is a gel.

14. A mitten according to claim 13, wherein said gel is enclosed in a fluid impervious package.

* * * * *